US005351518A

United States Patent [19]

Bogart et al.

[11] Patent Number: 5,351,518

[45] Date of Patent: Oct. 4, 1994

[54] FOUR SLIDER APPARATUS FOR FORMING CURVED RECTANGULAR BODIED NEEDLES AND METHOD

[75] Inventors: Michael W. Bogart, Milford; Richard J. Smith, Stamford, both of Conn.

[73] Assignee: United States Surgical Corporation, Norwalk, Conn.

[21] Appl. No.: 134,153

[22] Filed: Oct. 8, 1993

[51] Int. Cl.[5] ..... B21G 1/00

[52] U.S. Cl. ..... 72/401; 72/403; 163/1; 163/5; 140/71 R

[58] Field of Search ..... 72/399–401, 72/403; 163/1, 5; 140/77, 72, 80, 71 R

[56] References Cited

U.S. PATENT DOCUMENTS

| | | | |
|---|---|---|---|
| 500,058 | 6/1893 | Ellis | 140/88 |
| 1,432,573 | 10/1922 | Senft . | |
| 1,744,030 | 1/1930 | Chadwick . | |
| 3,861,446 | 1/1975 | Zocher | 163/5 |
| 3,929,082 | 12/1975 | Zocher | 72/324 |
| 4,044,814 | 8/1977 | Zocher | 72/324 |
| 4,524,771 | 6/1985 | McGregor et al. | 128/339 |
| 5,041,127 | 8/1991 | Troutman | 606/223 |
| 5,287,721 | 2/1994 | Samsel | 163/5 |

FOREIGN PATENT DOCUMENTS

| | | | |
|---|---|---|---|
| 230836 | 10/1991 | Japan | 163/5 |
| 281025 | 12/1991 | Japan | 163/1 |

*Primary Examiner*—Daniel C. Crane

[57] ABSTRACT

An apparatus for forming a curved, flat sided surgical needle, which comprises a frame member including an anvil member having an arcuate surface profile; a movable first die member for simultaneously imparting an arcuate profile and at least a pair of first opposing flat surfaces to a body portion of a needle blank and adapted to receive a needle blank, the first die member having an arcuate needle forming surface which is substantially parallel to the arcuate surface of the anvil member; a first side tool for curving a tapered end portion of the needle blank about the anvil; a transfer tool adapted to slide the needle blank along the anvil a side press adapted to import second flat surfaces to a second pair of opposing sides of the body portion of the needle blank; a second side tool member for curving a drill end portion of the needle blank about the anvil; and an ejection tool for moving the needle blank away from the anvil.

18 Claims, 8 Drawing Sheets

FOUR SLIDER APPARATUS FOR FORMING CURVED RECTANGULAR BODIED NEEDLES AND METHOD

BACKGROUND OF THE INVENTION

1. Field of the Invention

The present invention relates to needle forming devices. More particularly, the invention relates to a multistation needle forming apparatus for simultaneously flat pressing, and curving and then side pressing a needle blank to form curved, rectangular bodied needles. The apparatus is capable of forming the needle blank about a single forming member.

2. Description of the Related Art

The production of needles involves many processes and different types of machinery in order to prepare quality needles from raw stock. These varying processes and machinery become more critical in the preparation of surgical needles where the environment of intended use is in humans or animals. Some of the processes involved in the production of surgical grade needles include, inter alia: straightening spooled wire stock, cutting needle blanks from raw stock, tapering or grinding points on one end of the blank, providing a bore for receiving suture thread at the other end of the blank, imparting flat surfaces on opposite sides of the blank by flat pressing a portion of the needle blank to facilitate grasping by surgical instrumentation and curving the needle where curved needles are desired. Additional processing may be done to impart flat surfaces substantially perpendicular to the flat pressed portions of the needle blank by side pressing a portion of the needle blank to further facilitate grasping by surgical instrumentation and insertion into humans or animals. Conventional needle processing is, in large part, a labor intensive operation requiring highly skilled labor. Generally, extreme care must be taken to ensure that only the intended working of the needle is performed and the other parts of the needle remain undisturbed.

Curved rectangular bodied needles have advantages over other needle configurations in many surgical procedures for a variety of reasons including, uniformity of entry depth for multiple sutures and proper "bite" of tissue surrounding the incision or wound. When providing curved rectangular bodied needles for surgical procedures it is desirable for the needles to have a specified rectangular cross-section and a specified curvature, i.e., a predetermined radius of curvature. The desired cross-section and radius of curvature for the finished needle varies with specific applications.

Known methods of forming curved rectangular bodied needles require several separate and distinct operations on various machinery. The needle blank must first be flat pressed to impart initial flat surfaces along body portions of the needle blanks located between a tapered point end of the blank and a drilled end. After flat pressing, the needle blank can then be taken from the flat press dies to a curving machine to impart the proper curvature to the needle blank. Care must be taken when removing the blanks from the flat press dies and positioning the needle blank in the curving machinery to avoid disturbing the flat surfaces imparted by the flat pressing operation. After curving, the flat pressed and curved needle blanks can then be taken from the curving anvil to a side press station to impart flat surfaces substantially perpendicular to the flat pressed sides to give the final rectangular cross sectional profile to the needle body. Again care must be taken during removal of the needle blanks from the curving anvil and during side pressing so as to avoid disturbing the previously imparted flat pressed and curved portions of the needle blank.

When needles are made of steel or similar resilient materials, the anvil or mandrel used should have a smaller radius than the radius desired in the final needle. This configuration allows for some springback after the bending operation and ensures that the desired radius of curvature is attained. A disclosure of such features may be found in, for example, U.S. Pat. No. 4,534,771 to McGregor et al. Needles improperly positioned on the anvil may result in a deformation of the previously imparted flat press sides and may have to be reprocessed or discarded.

One disadvantage to conventional needle forming techniques is that typically only one needle processing operation at a time, such as, for example, flat pressing between a pair of dies, curving around an anvil structure or side pressing between another set of dies, can be performed on a single piece of machinery. A further disadvantage is the long processing time and high costs required in forming and transporting the needles between the various machinery. Lastly, a still further disadvantage is the need to readjust several pieces of machinery to process needles of varying lengths and diameters thereby further increasing production time and costs.

Therefore, a need exists for a single needle forming apparatus that is capable of simultaneously flat pressing, and curving, and side pressing a simultaneously needle blank by forming the needle blanks about a single forming member of the same apparatus. It is also desirable to provide a needle forming device which cooperates with a needle feeding fixture for sequentially loading and positioning one or more needles against the forming surface so as to increase the production rate of the needle manufacturing process by maintaining a continuous flow of needle blanks through the device.

SUMMARY OF THE INVENTION

There is disclosed an apparatus which includes a frame portion and means associated with the frame portion for substantially simultaneously imparting an arcuate profile and a first pair of opposing flat surfaces to a body portion of a needle blank. The apparatus further includes means associated with the frame portion for imparting a second pair of opposing flat surfaces to the body portion of the needle blank such that the second pair of opposing flat surfaces are substantially parallel to the first pair of opposing flat surfaces. In particular, there is discloses an apparatus for forming a curved, flat sided surgical needle, which includes a frame member including an anvil member having an arcuate surface profile; a movable first die member for imparting an arcuate profile to a first pair of opposing sides of a body portion of a needle blank and adapted to receive a needle blank, the first die member having an arcuate needle forming surface which is substantially parallel to the arcuate surface of the anvil member; and a first side tool for curving a tapered end portion of the needle blank about the anvil; there is also provided a transfer tool adapted to slide the needle blank along the anvil; a side press adapted to import second flat surfaces to second opposing sides of the body portion of the needle blank; a second side tool member for curving a drilled end portion of the needle blank about the anvil; and an ejection tool for moving the needle blank away from the anvil.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENT

Generally, the needle forming apparatus of the present invention is utilized to simultaneously curve and flat press a needle blank and then side press a body portion of the blank in order to form a curved, rectangular bodied needle. Means are provided for protecting tapered and drilled end portions of the needle blanks during the forming operations. As used herein, the term needle blank refers to a surgical needle in various stages of fabrication.

Figure 1:
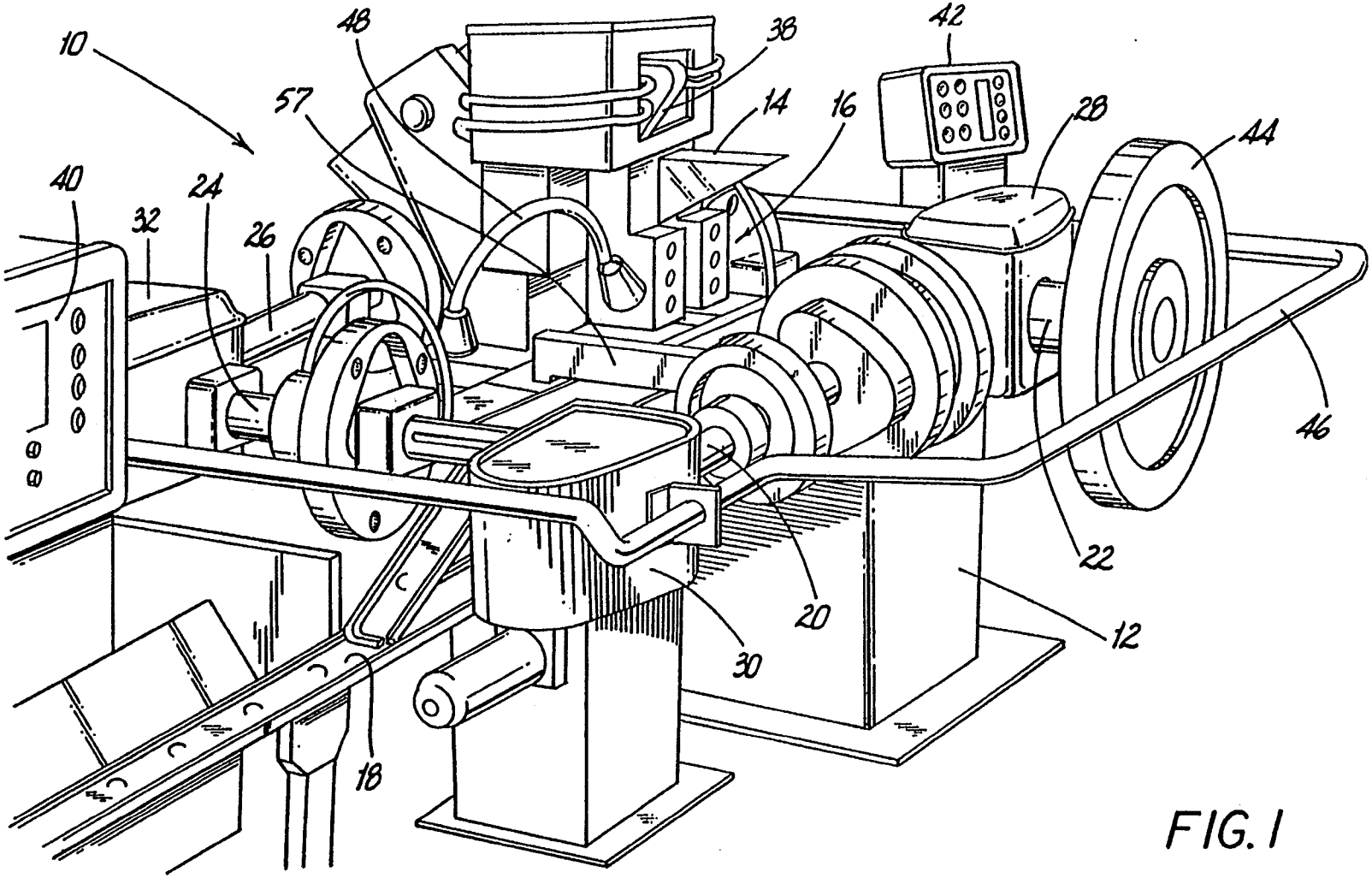
FIG. 1 is a perspective view of the needle forming apparatus of the present invention.
Figure 2:
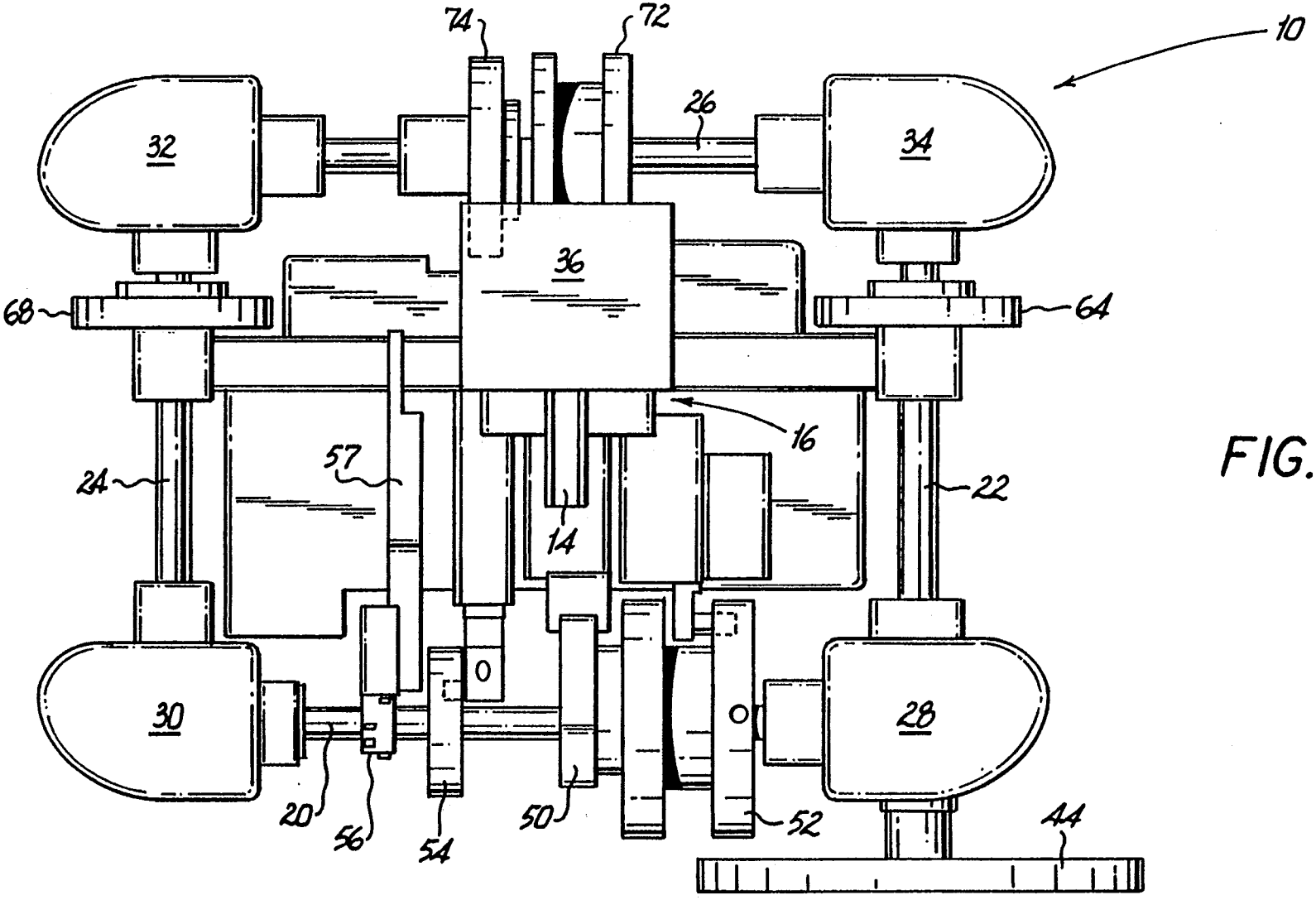
FIG. 2 is a top plan view of the needle forming apparatus of FIG. 1.

Referring to FIGS. 1 and 2, needle forming apparatus 10 generally includes a support stand or frame 12, a feeding hopper 14, a needle forming station 16 and an offload conveyor belt 18. As used herein, the term "frame 12" refers at various times to all or part of the supports or frame members of apparatus 10 used to support the operative machinery as the situation may necessitate.

Apparatus 10 also includes a front camshaft 20, a right side camshaft 22, a left side camshaft 24 and a rear camshaft 26. Camshafts 20, 22, 24 and 26 are driven by motors 28, 30, 32 and 34, respectively, and are provided to drive and sequence the movements of the various die plates and tools of apparatus 10 by known methods. A toggle tower 36 houses a toggle link 38 used to operate the side press die. Control stations 40 and 42 are provided to control the various motors and thus the operation of apparatus 10.

Referring still to FIG. 1, a flywheel 44 may be provided on one of the shafts to stabilize the motions of the various cam shafts. A safety mechanism, in the form of a guard rail 46, is provided to protect the user. A sensor (not shown) may be incorporated into guard rail 46 and used to shut off apparatus 10 when an operator or bystander crosses over guard rail 46. Further, a light 48 may be provided to illuminate needle forming station 16 to aid in viewing the needle forming operations.

Referring now to FIG. 2, front camshaft 20 includes four cams 50, 52, 54 and 56 which control the motions of a front tool 58, an auxiliary plate 60 and a transfer tool 62, respectively. Cams 54 and 56 control the horizontal and vertical motions, respectively, of transfer tool 62. Right side camshaft 22 includes a cam 64 which controls the motions of a right side tool 66. Left side camshaft 24 has a cam 68 which controls the motions of a left side tool 70. The last camshaft, rear camshaft 26, has a pair of cams 72 and 74 which control the motions of toggle link 38 and an ejection tool 76, respectively. As noted above, the various cams on the cam shafts sequence and control the travel and dwell of the various die and tool members using known methods.

Figure 3:
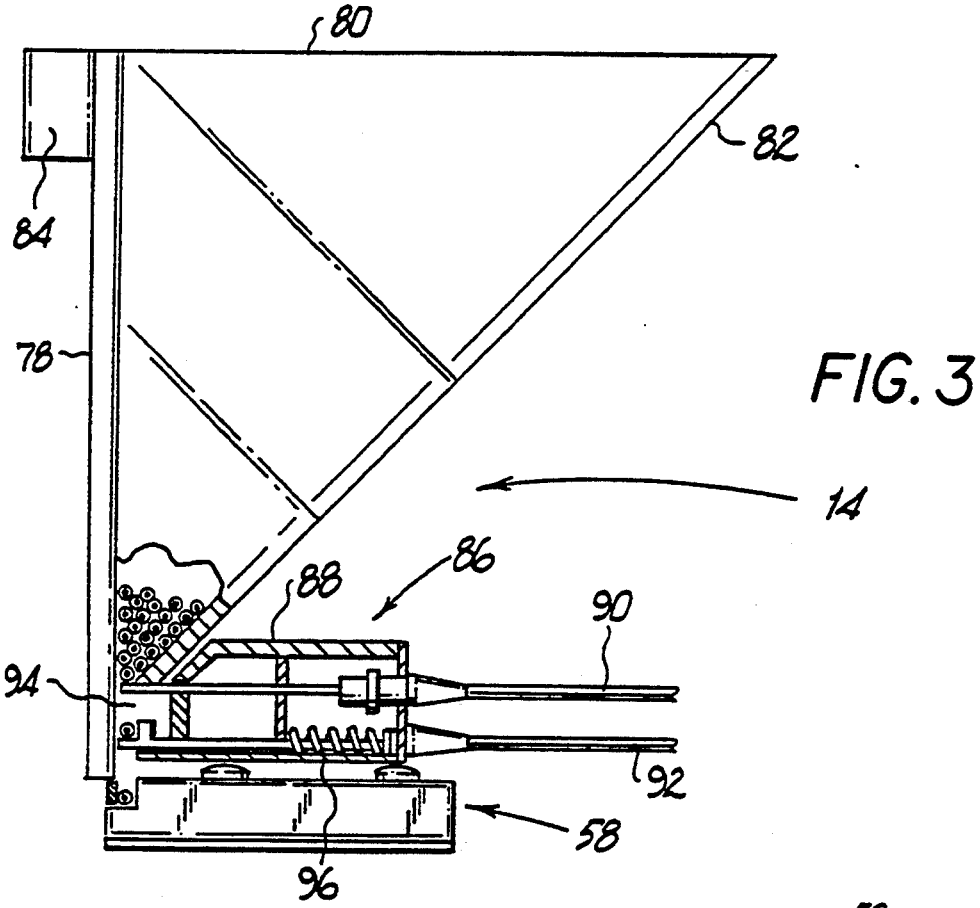
FIG. 3 is a side elevational view of the needle feeding mechanism of the apparatus of FIG. 1.

As shown in FIG. 3, feeding hopper 14 is adapted to hold a plurality of drilled and tapered needle blanks and transfer the blanks one at a time to front tool 58. Feeding hopper 14 includes a back plate 78, a pair of side plates 80 and a front plate 82 which is angled with respect to back plate 78 to form a V-shaped needle holding hopper therebetween. Preferably, side plates 80 are formed of a transparent material such as, for example, a plastic material, to facilitate observation of the amount needle blanks remaining in hopper 14. Back plate 78 may include a mounting block 84 for detachably mounting hopper 14 on frame 12. Hopper 14 further includes a feeding mechanism 86 for transferring one needle blank at a time from hopper 14 to front tool 58. Feeding mechanism 86 includes a box 88 containing upper and lower feed rods 90 and 92, respectively. Upper feed rod 90 drops one needle at a time into a staging area 94 and lower feed rod 92 moves against a spring 96 to deposit one needle at a time into front tool 58. Feed rods 90 and 92 are controlled by solenoid controled pneumatic cylinder.

Figure 4:
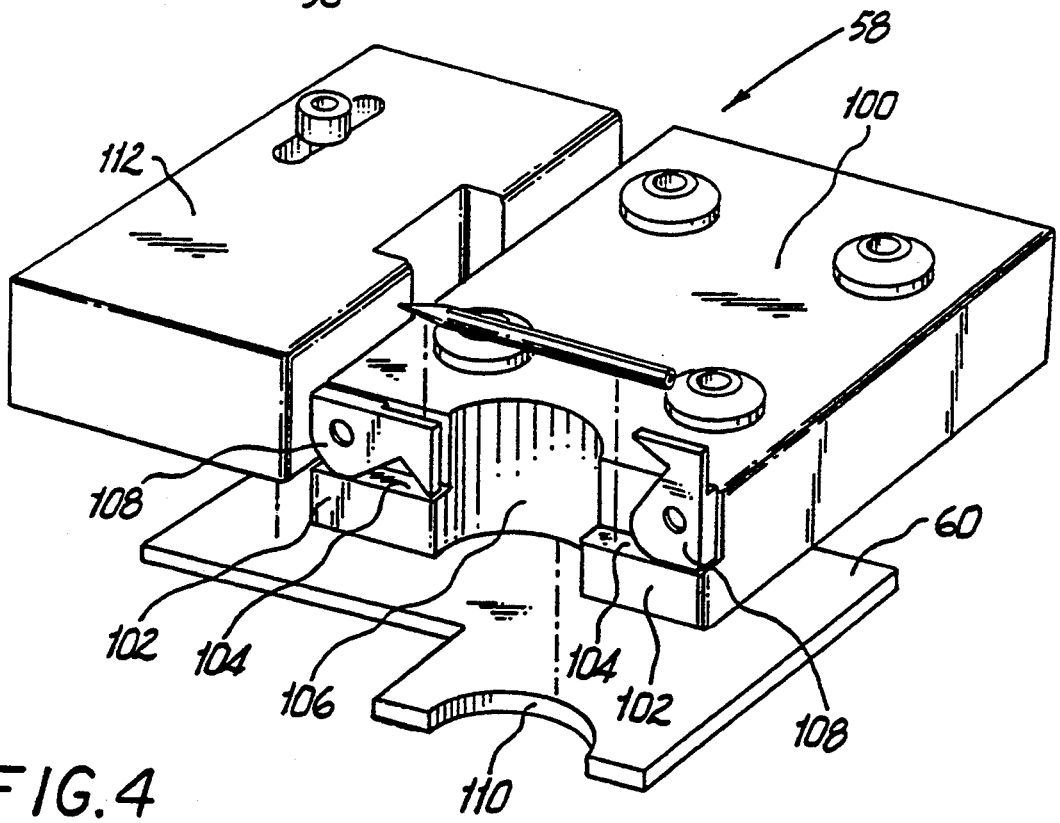
FIG. 4 is a perspective view of the top slide plate and the auxiliary slide plate thereof.
Figure 6:
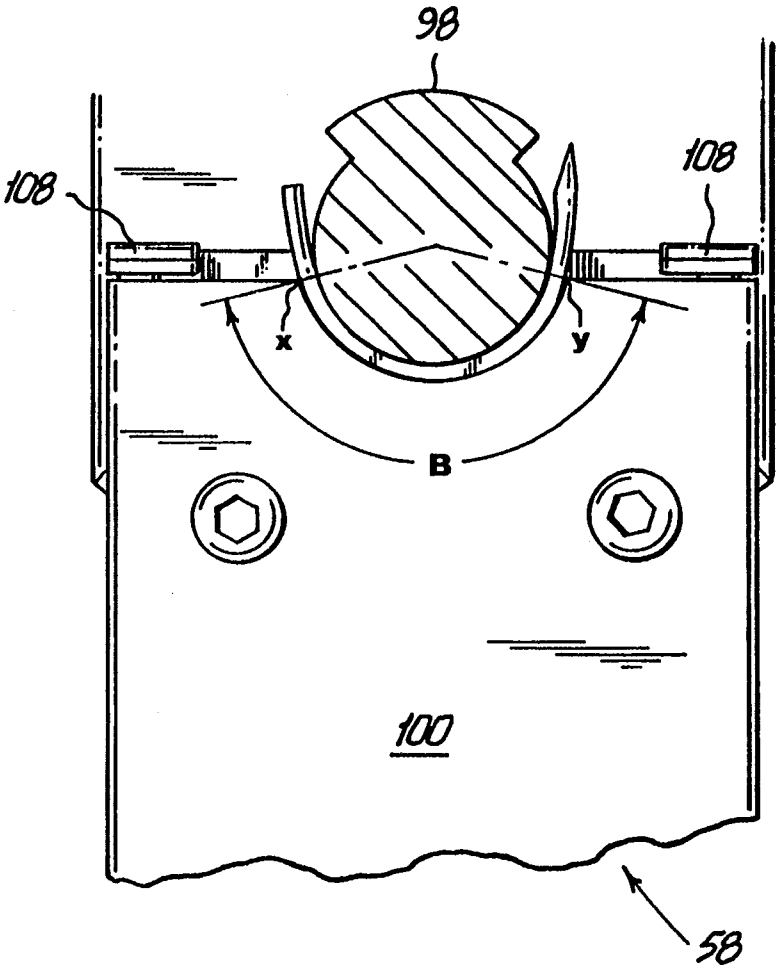
FIG. 6 is a partial top plan view of the top slide plate forming a needle blank about the mandrel thereof.
Figure 5:
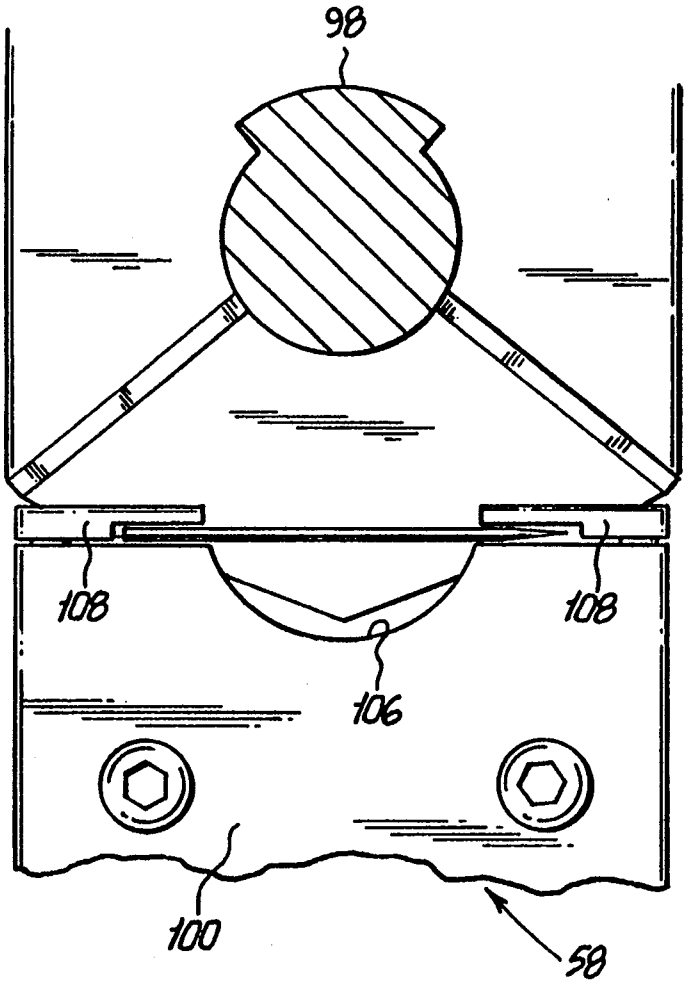
FIG. 5 is a partial top plan view of the top slide plate and forming mandrel prior to forming a needle blank thereof.

Referring now to FIGS. 3 and 4, front tool 58 is provided to receive a needle blank from feed mechanism 86 and simultaneously curve and flat press a body portion of the needle blank against an elongated, curved forming surface or mandrel 98 as shown in FIGS. 5 and 6. Front tool 58 includes a main body portion 100 having a pair of projecting portions 102 each of which are provided with a needle supporting surface 104. Body portion 100 further includes an arcuate die face 106, positioned between projecting portions 102, which is dimensioned and configured to simultaneously impart an arcuate profile and a pair of opposing flat surfaces to a body portion of the needle blank when pressed against mandrel 98. Surface 106 may have a radius of about 0.05 to 3.00 and preferably of about 3.00. Surface 106 is parallel to mandrel 98 to impact opposing flat surfaces to a needle blank pressed therebetween. Front tool 58 may further be provided with a pair of pivoting retention arms 108 mounted on body portion 100. Retention arms 108 help define a recess for receipt of a needle blank and help hold the needle blank in place on surfaces 104 when front tool 58 is moved from a position adjacent feeding station 16 to a position near mandrel 98.

As shown in FIGS. 5 and 6, front tool 58 is moveable from a first position remote from mandrel 98 where front tool 58 receives and retains a needle blank to a second position where retention arms 108 pivot upwards to allow die face 106 to partially form the needle blank about mandrel 98. Die face 106 partially forms the needle blank by simultaneously curving the body portion of the blank around mandrel 98 and flat pressing the portion of the needle blank body between die face 106 and mandrel 98. Mandrel 98 is preferably provided with a radius of about 0.05 to about 3.00 and preferably about 3.00. As further shown in FIG. 6, only the body portion of the needle blank extending from points x to y is curved against mandrel 98 through an arc $\beta$ of about 135 degrees. This prevents tapered and drilled end portions of the needle blank from being flat pressed between mandrel 98 and front tool 58.

Figure 9:
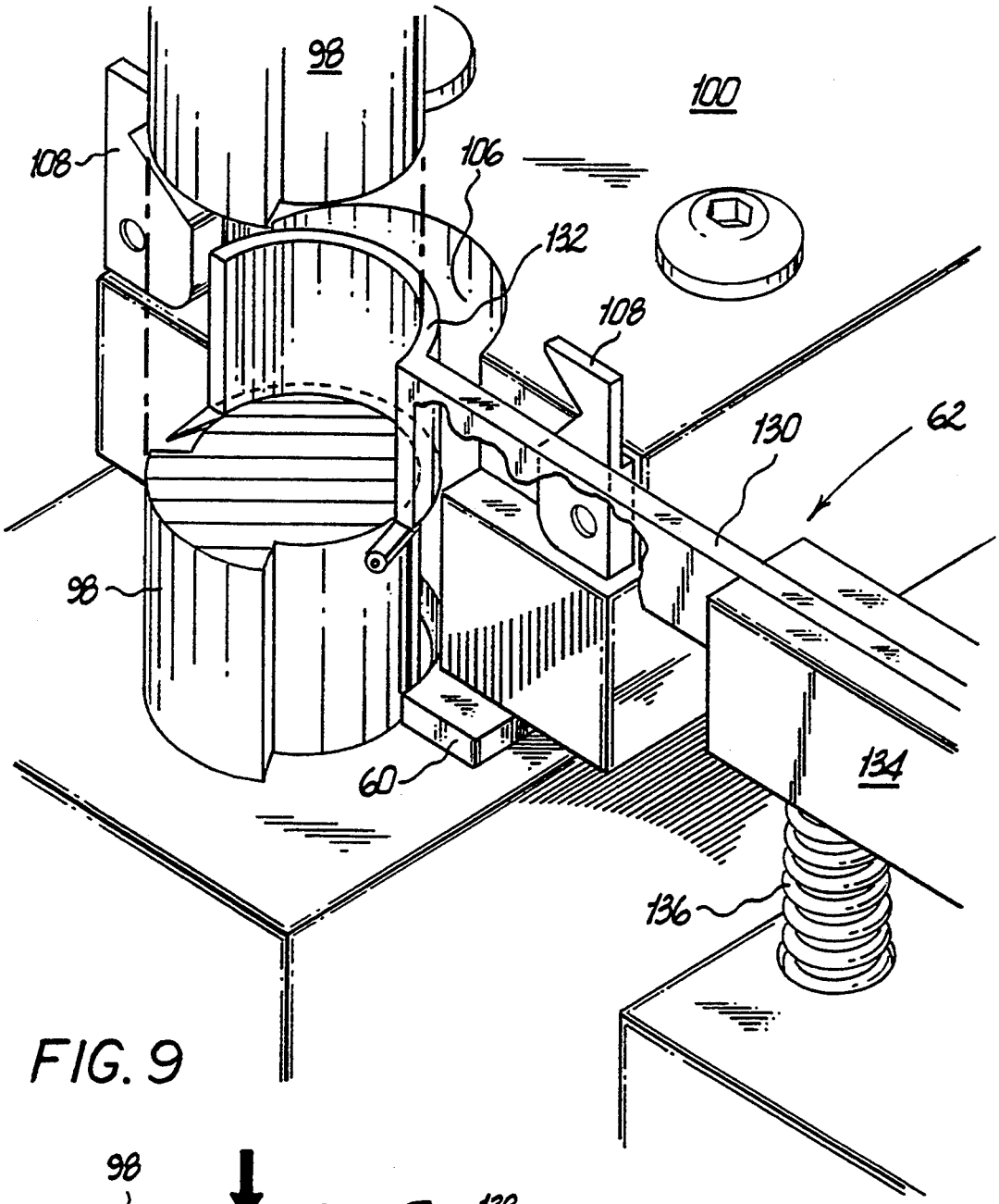
FIG. 9 is a partial perspective view showing the transfer tool engaging a partially formed needle blank.

Referring again to FIG. 4, auxiliary plate 60 is located beneath front tool 58 and has an arctare surface 110 at one end thereof which corresponds to the arctare surface front tool 58. Arctare surface 110 of auxiliary plate 60 helps define a space between auxiliary plate 60 and mandrel 98 for receipt of the needle blank, as shown in FIG. 9, and to maintain the blank against the mandrel during curving of the drilled end portion of the blank and side pressing of the body portion of the blank. A side block 112, affixed to auxiliary plate 60 and offset from front tool 58, is provided to receive the motions of cam 52 move auxiliary plate 60 independently of front tool 58.

As noted above, front tool 58 is adapted to curve the body portion of the needle blank between die face 106 and mandrel 98. In order to provide a true continuously curved needle blank it is also desirable to curve the tapered end portion and drilled end portion of the needle blank. However, this must be done in a manner which ensures that the tapered and drilled end portions are not damaged or distorted.

Figure 7:
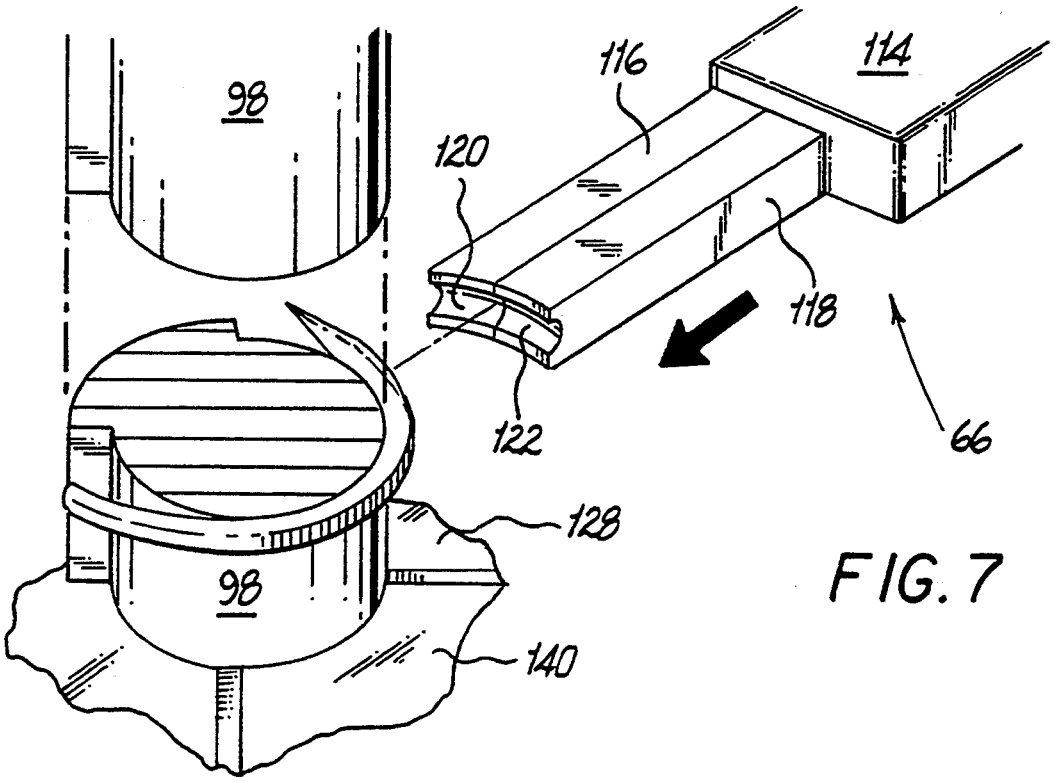
FIG. 7 is a partial perspective view of the right side bending tool die.
Figure 8:
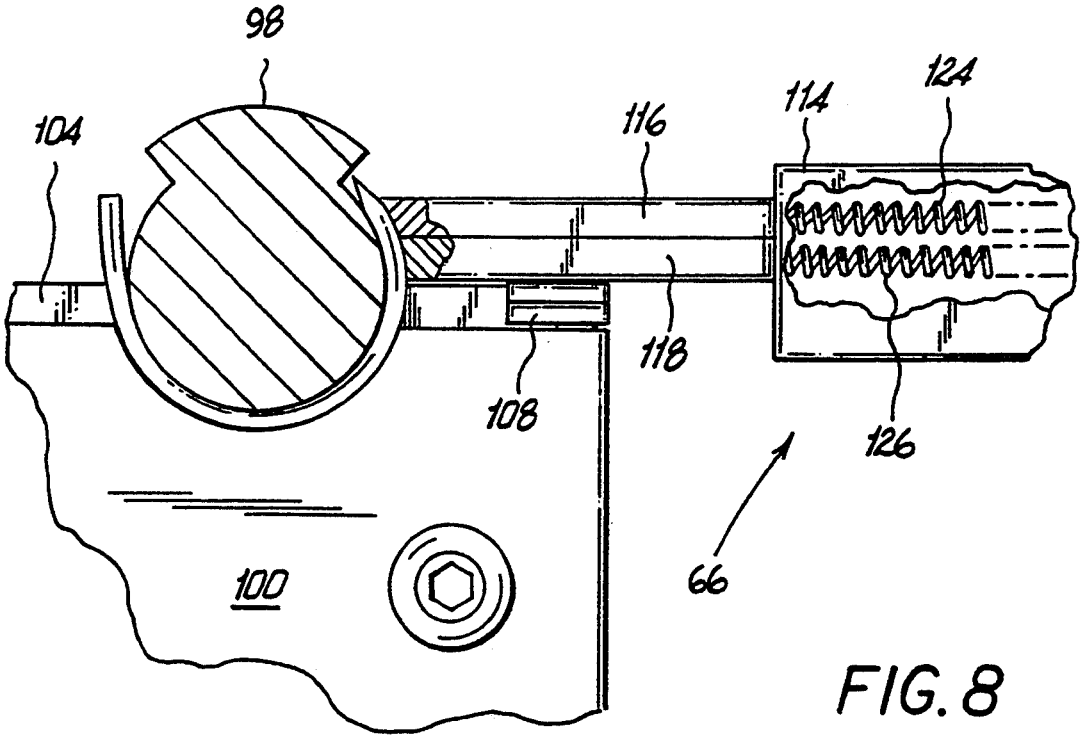
FIG. 8 is a partial top plan view of the right side bending tool die forming the tapered point end of the needle about the mandrel.

As shown in FIGS. 7 and 8, right side tool 66 ms provided to curve the tapered end portion of the needle blank while the needle blank is held against mandrel 98 by front tool 58. Right side tool 66 includes a body member 114 and a pair of curving arms 116 and 118 terminating in curving faces 120 and 122, respectively. Curving faces 120 and 122 are dimensioned and configured to bend the tapered end portion of a needle blank about mandrel 98 without damaging the tapered end portion in any manner. Further, curving arms 116 and 118 are biased out from body member 114 by springs 124 and 126, respectively, to further cushion the pressure of faces 120 and 122 against the taped end portion. Still referring to FIGS. 7 and 8, right side tool 66 is movable from a position remote from the needle blank held between front tool 58 and mandrel 98 to a position abutting the tapered end portion of the needle blank to gently curve the tapered end portion about mandrel 98. As noted above, the motions of right side tool 66 are controlled and sequenced by camshaft 22 and, in particular, cam 64.

In order to ensure rapid, consistent and reliable formation of a needle blank, it is desirable to feed the needle blanks into forming stations 16 from hopper 14 above front tool 58 and eject the fully formed needle blank out beneath front tool 58 and onto offload conveyor belt 18. Thus, once the tapered end portion of the needle has been curved it is preferable to slide the needle blank down between mandrel 98 and front tool 58 to a position between auxiliary plate 60 and mandrel 98 and adjacent a lower side die face 128.

Figure 14:
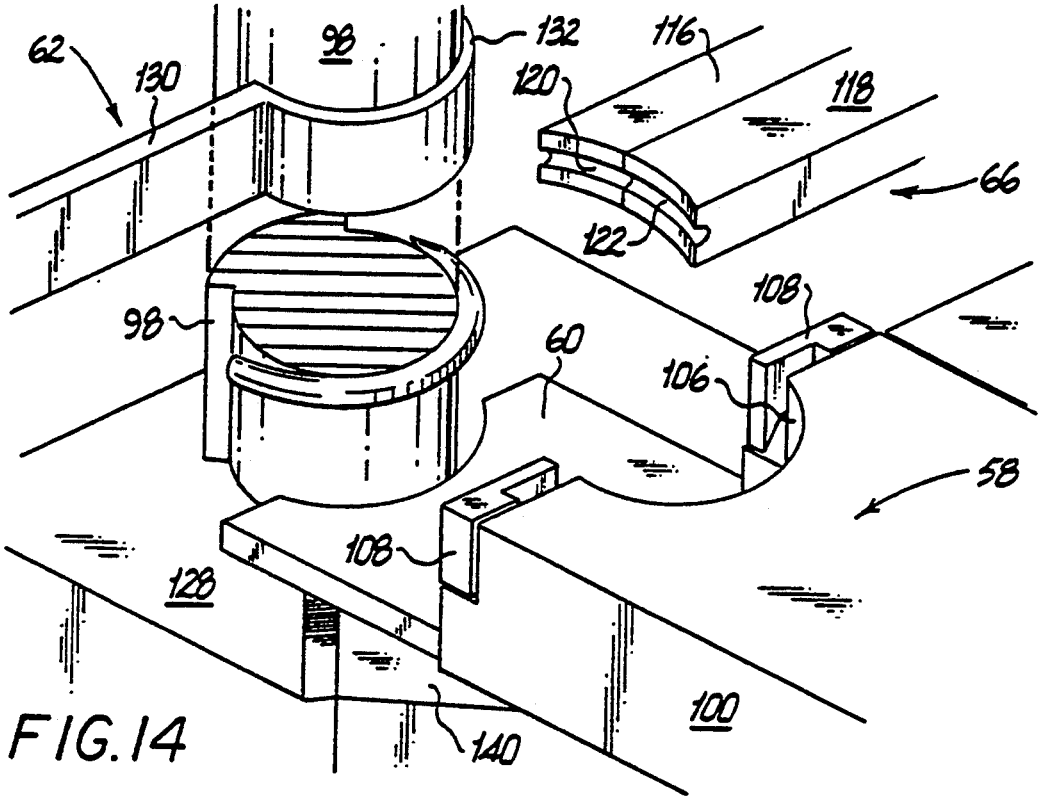
FIG. 14 is a partial perspective view illustrating the relationship of the top slide tool, the auxiliary slide tool, the right slide tool and the transfer tool relative to the mandrel member.
Figure 15:
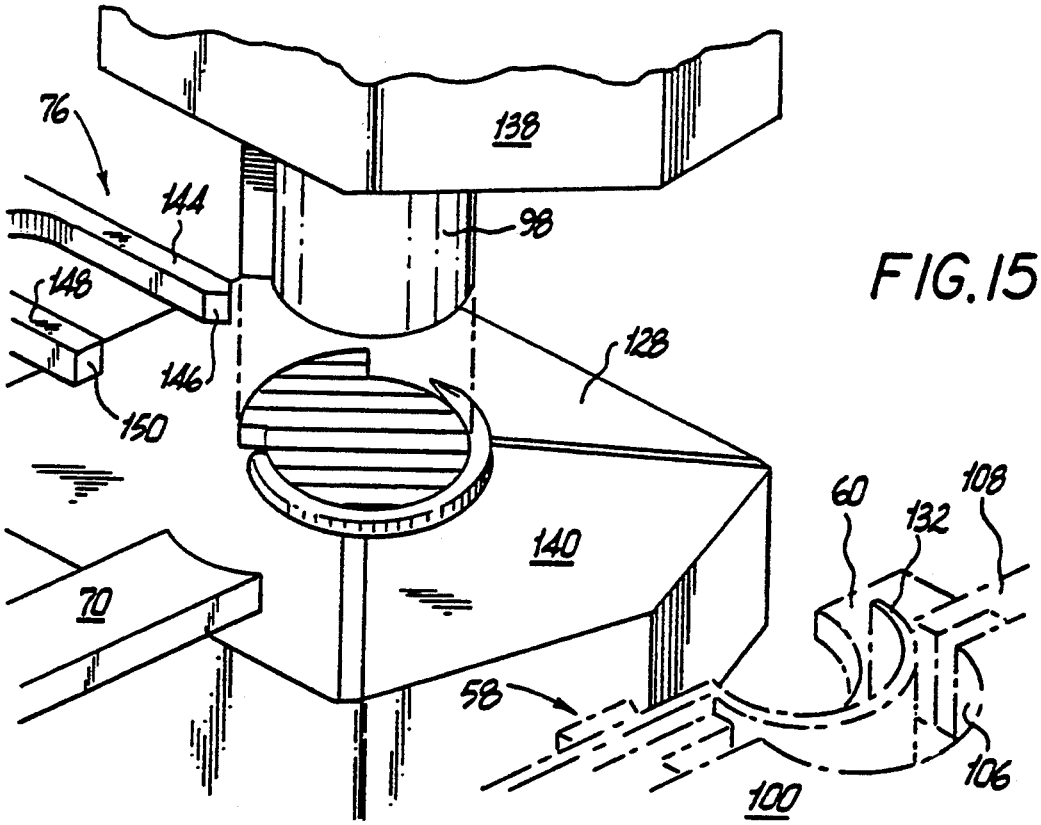
FIG. 15 is a perspective view similar to FIG. 14 illustrating the operation of the side press die.

As shown in FIGS. 9, 14 and 15, transfer tool 62 is provided in order to rapidly and consistently move the needle blank down along mandrel 98. Transfer tool 62 includes a stem portion 130 ending in an arcuate transfer arm 132. Transfer arm 132 is of approximately the same radius of curvature as mandrel 98 and has a thickness of less than or equal to the thickness of the flat pressed needle blank. Stem 130 is held by a block 134 which is biased upwards by springs 136. Transfer tool 62 is movable horizontally toward and away from mandrel 98 by means of cam 54 and is slidable vertically along mandrel by means of cam 56. In this way transfer tool 62 is movable along a generally rectangular path to drive the needle blank down along mandrel 98, move back with front tool 58, rise and move forward to an initial position above front tool 58.

Figure 10:
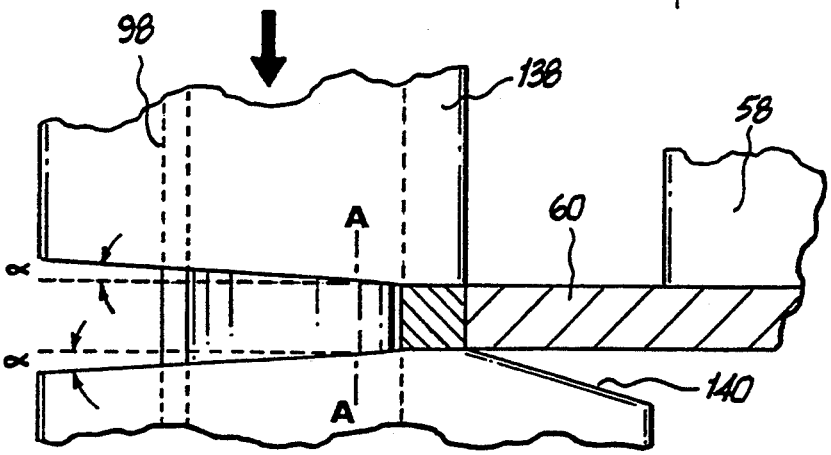
FIG. 10 is an enlarged partial side view illustrating the side press.

As noted above, in order to form a curved, rectangular bodied needle, it is necessary to side press the body portion of the needle blank without damaging the tapered or drilled end portions of the needle blank. As shown in FIG. 10, an upper side press die 138 is provided to impart flat surfaces on sides of the needle blank substantially perpendicular to the flat pressed sides by pressing the body portion of the blank between an upper die 138 and lower die face 128 to impart the final rectangular, and preferably square, cross-section to the body portion of the needle blank. In order to ensure that only the body portion of the needle blank is side pressed, upper die 138 and lower die face 128 trail off or angle back from a transition point A in order to provided a margin of clearance for the tapered and drilled end portions of the needle blank. The degree of these angled back portions or tapers are on the order of about 1° to about 10° and preferably about 2° to about 4°. As also shown in FIG. 10, a forward surface 140 of lower die face 128 angles downward to help direct a finished needle blank onto offload conveyor belt 18 during ejection of the blank from needle forming station 16.

Figure 11:
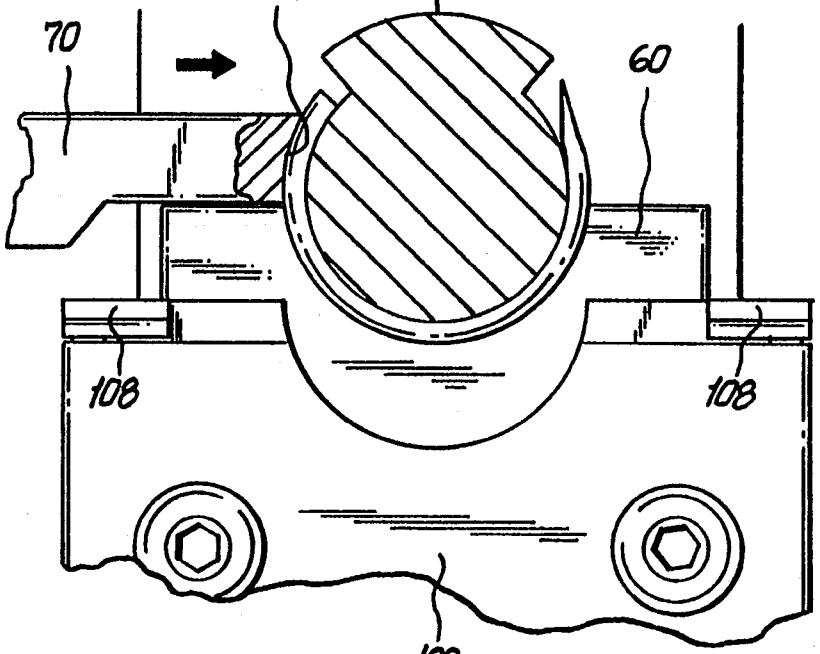
FIG. 11 is a partial top plan view showing the left side forming tool engaging the needle blank.

The last step in forming the curved, rectangular bodied needle is to curve the drilled end portion of the needle blank, again, without damaging the drilled end portion. As shown in FIGS. 11 and 15, left side tool 70 is provided to curve the drilled end portion of the needle blank, while it is held in place on mandrel 98 by auxiliary plate 60, and includes an arcuate forming surface 142. Surface 142 is adapted to bend the drilled end portion of the needle about mandrel 98 without damaging it. Left side tool 70 is driven by cam 68 on cam shaft 24.

Figure 12:
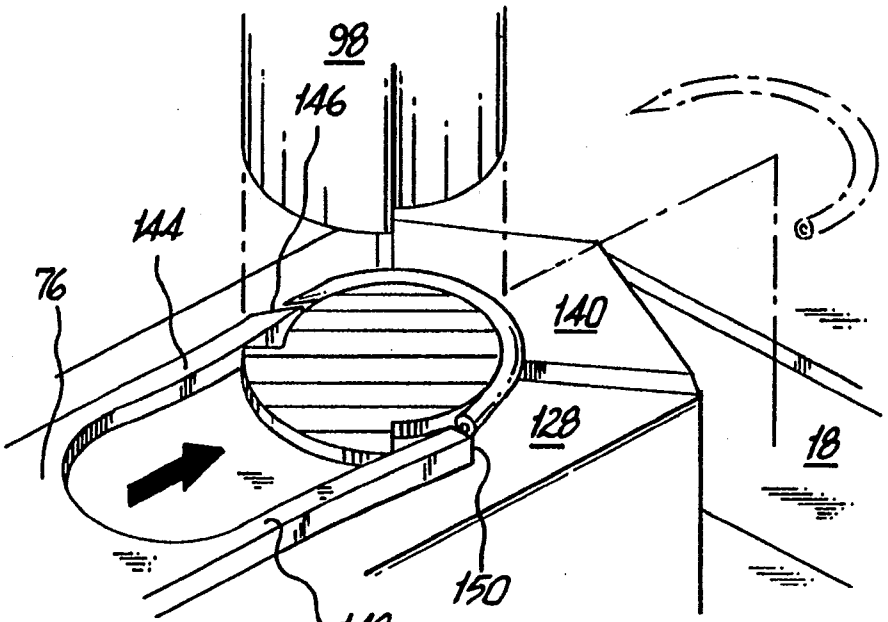
FIG. 12 is a partial perspective view showing the ejection tool.

Referring now to FIGS. 12 and 15, ejector tool 76 is provided to push the fully formed needle blank away from mandrel 98 and onto offload conveyor belt 18. Ejector tool 76 has an angled first pushing arm 144 having an angled tip 146 and a flat second pushing arm 148 having a blunt or flat tip 150 for engaging the tapered and drilled end portions of the needle blank, respectively. Cam 74 and rear cam shaft 26 drives ejector tool 76 to push a needle blank free from mandrel 98 in needle forming station 16.

Preferably, the tool and die members of apparatus 10 are formed of a steel having a hardness substantially greater than or equal to that of the needle blank. The tools and dies have a Rockwell hardness of about (55C) to (70C) and preferably about (62C).

In operation, a plurality of tapered and drilled needle blanks are initially loaded into hopper 14. The speed of apparatus 10 and the motions of the various members are programmed into the machine by means of control panels 40. Depending upon the sizes of the needle blanks process, various parameters such as die pressure, motor speed and die-strokes would be set on control stations 40. As noted above, a safety mechanism in the form of a sensor may be built into guard rail 46 to prevent operation of apparatus 10 until all users and bystanders are cleared away from the machinery. These safety features prevent hands or fingers from becoming caught in the various cam and die members during operation.

Referring now to FIG. 3, needle blanks initially loaded into hopper 14 move down between back plate 78, front plate 82 and side plates 80 toward staging area 94. Upper feed rod 90 is retracted a sufficient amount to allow a single needle blank to fall into staging area 94. It will be noted that at an initial start position of each full needle forming sequence front die plate 58 is positioned with needle supporting surfaces 104 located directly below staging area 94. At this point, lower feed rod 92 is retracted against the bias of spring 96 to allow a single needle blank to fall into the space defined by block 100, needle supporting surface 104 and retention arms 108. As noted above, retention arms 108 aid in maintaining the needle blank against surfaces 104 while the front die plate is advanced toward the mandrel member 98.

Referring now to FIGS. 5 and 6, as front tool 58 is advanced toward mandrel 98 side retention arms 108 Divot upwardly to allow the drilled end portion and tapered needle portion to move forward as tool 58 simultaneously bends and flat presses the body portion of the needle blank against mandrel 98. As noted above, curving surface 106 has an arcuate profile substantially similar to that of mandrel 98. The surface of mandrel 98 and surface 106 are parallel such that when pressing a needle blank therebetween, flat surfaces are imparted to opposing sides of the needle blank. Thus, simultaneous curving and flat pressing of the body portion of the needle blank is obtained by pressing the blank between mandrel 98 and front tool 58. As further noted above, once the needle blank has been curved and flat pressed, it is desirable at this stage to continue the arcuate profile around to the tapered end portion of the needle blank.

As shown in FIGS. 7 and 8, the right side tool 66 comes in causing arms 116 and 118 to gently impinge upon the tapered end portion of the needle blank thereby curving the tapered portion about the mandrel. Springs 124, 126 aid in softening the impact of the arms 116 and 118 respectively against the drilled needle blank. Curved faces 120 and 122 are sufficiently recessed so as to prevent any damage to the tapered end portion of the needle blank during this curving step. It will be noted during the curving of the tapered end portion of the needle blank, the needle blank is held against mandrel 98 in a position slightly above lower die face 128 by means of curving face 106 of front tool 58. After curving of the tapered end portion of the needle blank, right side tool 66 retracts to its initial position away from mandrel 98 as shown in FIGS. 7 and 15.

As can be seen in FIG. 14, transfer tool 62 is initially disposed above the curved and flat pressed needle blank along mandrel 98. It is desirable at this stage to move the needle blank down along mandrel 98 to position adjacent lower die face 128 for side pressing of the needle blank, curving of the drilled end portion of the needle blank and final ejection of the needle blank down surface 140 onto off-load conveyor belt 18.

Referring now to FIG. 9, it can be noted at this point front tool 58 retracts slightly to allow transfer tool 62 to slide down between inner surface 106 of front tool 58 and mandrel 98 thereby pushing down the needle blank into the gap formed between auxiliary plate 60 and mandrel 98. Transfer tool 62 is driven downward toward the bias of springs 136 by means of cam 56 on the front cam shaft 20 and rocking lever 57. Specifically, cam 56 pivots rocking lever 57 which abruptly moves transfer tool 62 against the needle blank to drive it downward between the gap formed by auxiliary plate 90, auxiliary plate 60, mandrel 98 and lower die surface 128. As noted above, and as seen in FIG. 10, auxiliary plate 60 has a thickness which is approximately slightly less than or equal to the thickness of the final cross-sectional area of the side pressed needle blank. Once the needle blank has been moved down mandrel 98 by transfer tool 62, front tool 58 and transfer tool 62 retract to provide clearance for upper die 138 and return to their original start positions.

Referring now to FIG. 10, at this point cam 72 on rear cam shaft 26 operates toggle link 38 in toggle mower 36 to drive the upper die 138 down against the needle blank, thereby side pressing the needle blank between upper die 138 and lower die surface 128 to impart a final rectangular cross-sectional shape to the body portion of the needle blank. As noted above, tapers a in upper die 138 and low die surface 128 provide clearance areas for the tapered end portion and drilled end portion of the needle blanks such that material in those areas are not side pressed. In a preferred embodiment, these tapered portions or these angled portions or tapers are on the order of about 1° to about 10° and more preferably on the order of about 2° to about 4°.

Referring now to FIGS. 11–13 and 15, once the needle has been side pressed by upper die 138, final processing of the blank can be performed by left side tool 70 which is driven by cam 68 on left cam shaft 24 to impart the final curve to the drilled end portion of the needle blank. Tool 70 presses the drilled end portion of the needle blank between surface 142 of left tool 70 and the mandrel member 98 as shown in FIG. 11. It will be noted that during both the side pressing operation with dies 129 and 138 and the curving operation with left side tool member 70, the needle blank is held against mandrel member 98 by means of auxiliary plate 60. After final curving of the drilled end portion of the needle blank, auxiliary plate 60 along with front tool 58 and transfer tool 62 retract back away from mandrel member 98 as shown in FIG. 14. Upper die member 138 and left side tool 70 similarly retract away from the now fully formed needle blank as shown in FIG. 15.

Referring now to FIGS. 12 and 15, after the needle blank has been fully formed, ejector tool 76 is driven forward by an ejector cam 74 on rear cam shaft 34 to drive the needle blank off of mandrel 98 and down angled surface 140 onto offload conveyor belt 18. Angled surface 146 at the end of arm 144 of ejector tool 76 wedges between the tapered point of the needle blank and mandrel 98 to slide that portion of the needle blank away from mandrel 98. Similarly, the flat or blunt edge 150 of the arm 148 of ejector member 176 abuts the drilled end portion of the needle blank to in conjunction with angled surface 146 drive the needle blank off of mandrel 98 and onto offload conveyor belt 18.

Figure 13:
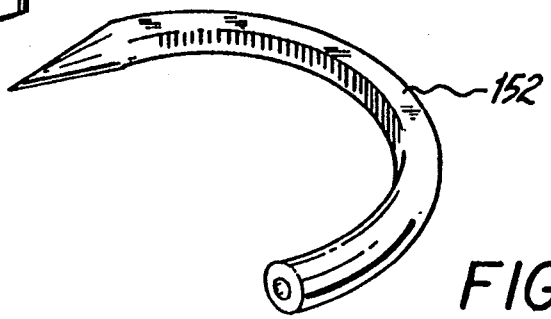
FIG. 13 is a perspective view illustrating a surgical needle formed according to the apparatus of FIG. 1.

Apparatus 10 is adapted to handle needles having lengths ranging from about 0.300 to 2.5 in. A complete forming cycle can take from approximately 0.3 sec. to 2 sec. and preferably 1. Thus, apparatus 10 is capable of forming approximately 60 needles per minute. A curved rectangular body needle 152 formed on apparatus of the present invention is illustrated in FIG. 13.

It will be understood that various modifications can be made to the embodiments of the present invention herein disclosed without departing from the spirit and scope thereof. For example, various sizes of the dies are contemplated, as well as various types of construction materials. Also, various modifications may be made in the configuration of the parts. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. An apparatus for forming a curved, flat sided surgical needle, which comprises:

a) a frame portion; and b) means associated with said frame portion for substantially simultaneously imparting an arcuate profile and a first pair of opposing flat surfaces to a body portion of a needle blank.

2. An apparatus for forming a curved, flat sided surgical needle which comprises:

a) a frame member including a forming member, having an arcuate surface;

b) first tool means mounted on said frame member and movable with respect thereto for simultaneously imparting an arcuate profile and at least a first pair of opposing flat surfaces to a body portion of a needle blank; and c) means for moving said first tool means from a first position remote from said forming member to a second position adjacent said forming member.

3. The apparatus as recited in claim 2 wherein:

a) said forming member includes an anvil having an arcuate surface; and b) said first tool means includes a first movable die member adapted to receive a needle blank, said first die member having an arcuate needle forming surface which is substantially parallel to said arcuate surface of said anvil member.

4. The apparatus as recited in claim 2, further comprising first side tool means to curve a tapered end portion of the needle blank.

5. The apparatus as recited in claim 4, wherein said first side tool means includes a first side tool having an arcuate recessed needle engaging surface at one end thereof, said first side tool movable from a position remote from said forming member to a position wherein said first die tool bends said tapered end portion between said arcuate recessed surface and said forming member.

6. The apparatus as recited in claim 2, further comprising means for moving the needle blank from a first position on said forming member to a second position on said forming member.

7. The apparatus as recited in claim 6, wherein said moving means includes a transfer bar adapted to slide the needle blank along said forming member from said first position to said second position.

8. The apparatus as recited in claim 2 further comprising side press means to impart a second pair of flat surfaces to second opposing sides of the body portion of the needle blank, such that the second flat surfaces are substantially perpendicular to said first flat surfaces.

9. The apparatus as recited in claim 8 wherein said side press means includes a first side press surface stationary with respect to said forming member and a second side press surface slidable along said forming member, wherein the body portion of the needle blank is pressed between said first and second side press surfaces.

10. The apparatus as recited in claim 2, further comprising means to curve a drilled end portion about said forming member.

11. The apparatus as recited in claim 10, wherein said curving means includes a second side tool movable from a position remote from said forming member to a position bending the drilled end portion between said second side tool and said forming member.

12. An apparatus for forming a curved, flat sided surgical needle, which comprises:

a) a frame including an anvil member having an arcuate surface profile;

b) a movable first die member for simultaneously imparting an arcuate profile and a first pair of opposing flat surfaces to a body portion of a needle blank, and adapted to receive a needle blank, said first die member having an arcuate needle forming surface which is substantially parallel to said arcuate surface of said anvil member;

c) a first side tool for curving a tapered end portion of the needle blank about said anvil;

d) a transfer tool adapted to slide the needle blank along said anvil;

e) a side press adapted to impart second flat surfaces to second opposing sides of the body portion of the needle blank;

f) a second side tool member for curving a drill end portion of the needle blank about the anvil; and g) an ejection tool for moving the needle blank away from said anvil.

13. A method of forming a curved, flat sided surgical needle comprising the steps of:

a) loading a needle blank onto a first tool; and b) simultaneously curving and imparting first flat surfaces to at least a first pair of opposing sides of a body portion of the needle blank to produce said surgical needle.

14. The method according to claim 13, wherein said curving and imparting includes positioning the needle blank adjacent an arcuate surface of said first tool, and pressing the body portion of the needle blank between the first tool and an arcuate surface of a forming member at a first position on said forming member.

15. The method of claim 13, further comprising bending a tapered end portion of the needle blank between a forming surface and a first side tool member.

16. The method according to claim 14, further comprising transferring the needle blank to a second position on said arcuate surface of said forming member.

17. The method according to claim 13, further comprising side pressing the needle blank to impact second flat surfaces to second opposing sides of the body portion of the needle blank by pressing the body portion of the needle blank between an upper member and a lower die member, said second flat surfaces being imparted substantially perpendicular to said first flat surfaces.

18. The method according to claim 13, further comprising curving a drilled end portion of the needle blank by pressing the drilled end portion around said forming surface with a second side tool.

* * * * *